US006064049A

United States Patent [19]

Hoh

[11] Patent Number: 6,064,049

[45] Date of Patent: May 16, 2000

[54] MAGNETRON DRIVING CONTROL APPARATUS OF MICROWAVE OVEN AND METHOD THEREOF

[75] Inventor: Jung-Eui Hoh, Suwon, Rep. of Korea

[73] Assignee: Samsung Electronics Co., Ltd., Suwon, Rep. of Korea

[21] Appl. No.: 09/128,788

[22] Filed: Aug. 4, 1998

[30] Foreign Application Priority Data

Apr. 30, 1998 [KR] Rep. of Korea ..... 98-15638

[51] Int. Cl.[7] ..... H05B 6/68

[52] U.S. Cl. ..... 219/716; 219/705; 219/760

[58] Field of Search ..... 219/715, 716, 219/718, 702, 704, 705, 760, 761

[56] References Cited

U.S. PATENT DOCUMENTS 4,900,989 2/1990 Suenaga et al. ..... 315/224
5,171,949 12/1992 Fujishima et al. ..... 219/716
5,283,411 2/1994 Sung-Wan ..... 219/760

FOREIGN PATENT DOCUMENTS 63-281391 11/1988 Japan ..... 219/716
1-95491 4/1989 Japan ..... 219/716

*Primary Examiner*—Philip H. Leung
*Attorney, Agent, or Firm*—Burns, Doane, Swecker & Mathis, L.L.P.

[57] ABSTRACT

The magnetron driving control apparatus of a microwave oven and a method thereof by which voltage at output side of a high voltage transformer and voltage of a magnetron are detected by a first and second voltage detecting units and a cooking process status is discriminated according to changes of the voltage at the output side of the high voltage transformer and the voltage of the magnetron to control the driving of the magnetron, such that foodstuff is optimally cooked and an automatic cooking is performed without installment of high priced sensors to thereby reduce the manufacturing cost.

8 Claims, 7 Drawing Sheets

MAGNETRON DRIVING CONTROL APPARATUS OF MICROWAVE OVEN AND METHOD THEREOF

BACKGROUND OF THE INVENTION

1. Field of the Invention

The present invention relates to a microwave oven, and more particularly to a magnetron driving control apparatus of a microwave oven and method thereof adapted to control driving of a magnetron according to voltages of a high voltage transformer and the magnetron in response to variations of foodstuffs to optimally cook the foodstuffs.

2. Description of the Prior Art

Generally, a microwave oven according to the prior art includes, as illustrated in FIGS. 1 and 2, a body 1, a cooking chamber with a door 3 hinged thereto, a key input unit 40 for setting up cooking courses such as cooking function, cooking time, cooking start/stop and the like and a display unit 4 for displaying the cooking courses.

Furthermore, the body 1 is formed therein with a diaphragm 5 for driving the cooking chamber 2 and a waveguide 6 is welded to the diaphragm 5. The waveguide 6 is disposed at one side thereof with a magnetron 30 and an opening 7 through which microwaves generated from the magnetron 30 are eradicated into the cooking chamber 2.

Meanwhile, FIG. 3 is a schematic block diagram for illustrating a microwave oven thus constructed according to the prior art, where the microwave oven includes a relay unit 8, a high voltage transformer 10, a high voltage diode 20, a high voltage capacitor 25, a magnetron 30, a key input unit 40, a weight sensor 42, a gas sensor 44 and a control unit 50.

In FIG. 3, the relay unit 8 is a relay for supplying or cutting off a commercial alternating current AC voltage (by way of example, 220–240 V) turned on or off by a control signal of the control unit 50 to thereafter be supplied via input terminals A and B, and the high voltage transformer 10 for transforming the commercial AC voltage to a high voltage (approximately 2,200 V) and a low voltage (approximately 3.4 V) includes a first coil 12 for inputting the commercial AC voltage from outside, a second coil 47 for outputting the high voltage and a filament coil 16 for outputting a low voltage.

The high voltage diode 20 and the high voltage capacitor 25 are disposed between the high voltage transformer 10 and the magnetron 30, which receives a lower voltage to be heated and also receives a direct current DC type of high voltage via the high voltage diode 20 and the high voltage capacitor 25 to generate microwaves.

Furthermore, the key input unit 40 outputs a key signal corresponding to the cooking courses and the weight sensor 42 detects the weight of foodstuff and outputs a detected signal corresponding thereto.

The gas sensor 44 detects the amount of gas generated from the foodstuff being cooked and outputs a detected signal corresponding thereto. The control unit 50 outputs a control signal for driving the magnetron 30 according to the key signal from the key input unit 40 and simultaneously counts a cooking time and establishes a cooking time according to the signals detected from the weight sensor 42 and the gas sensor 44, and when the counted cooking time is above the established cooking time, outputs a control signal for stopping the drive of the magnetron 30.

In the microwave oven thus constructed according to the prior art, when a user inserts foodstuff into the cooking chamber 2 and establishes a cooking course via the key input unit 40 to input a cooking start, a key signal corresponding thereto is output from the key input unit 40 to the control unit 50 and the control unit 50 outputs a control signal for driving the magnetron to the relay unit 8 and counts the cooking time at the same time.

Successively, the commercial AC voltage is supplied to the first coil 12 of the high voltage transformer 10 to thereby cause the filament coil 16 to be applied with a low voltage and the second coil 14 with a high voltage at the same time.

The filament is pre-heated and the high voltage is transformed to a high voltage of DC type via the high voltage capacitor 25 and the high voltage diode 20, and the DC-type high voltage is supplied to two poles of the magnetron 30 to thereby cause the magnetron 30 to generate microwaves. The microwaves are radiated into the cooking chamber 2 via the opening 7 of the waveguide 6 to heat and cook the foodstuff therein.

At this time, a detected signal corresponding to the weight of the foodstuff is input from the weight sensor 42 to the control unit 50 and a detected signal corresponding to the amount of gas generated from the foodstuff is input from the gas sensor 44 to the control unit 50.

The control unit 50 now discriminates the weight of the foodstuff and the amount of gas generated from the foodstuff according to the detected signals from the weight sensor 42 and the gas sensor 44 and compares the discriminated weight and amount of gas with pre-established weight and amount of gas. The control unit 50 establishes a cooking time according to the compared result.

Furthermore, the control unit 50 discriminates whether the counted cooking time is above the established cooking time, and if the counted cooking time is above the established cooking time, the control unit 50 outputs a control signal to the relay unit 8 to stop driving the magnetron 30.

The commercial AC voltage supplied to the high voltage transformer 10 is now cut off by the control signal from the control unit 50, thereby stopping driving the magnetron 30 and completing the whole cooking operations of the microwave oven.

Meanwhile, let's assume that an output power of the magnetron 30 is $P_{in}$, and a power at a predetermined position in the cooking chamber 2 is $P_{out}$, the $P_{out}$ can be obtained by following formulae 1, 2 and 3.

$$P_{in}=E_s^2 \quad \text{Formula 1}$$

$$E_y=E_s \sin(\chi) \quad \text{Formula 2}$$

$$P_{out}=(E_y)^2=\{E_s \sin(\chi)\}^2=E_s^2 \sin(\chi)^2 \quad \text{Formula 3}$$

Where, $E_s$ is a field energy formed by microwaves generated from the magnetron 30, that is, input field energy, and $E_y$ is a field energy at the predetermined position in the cooking chamber 2, that is, output field energy.

Accordingly, the output power of the magnetron 30 is obtained by a squared value of $E_s$, the field magnitude formed by the microwaves generated from the magnetron 30.

At this time, the microwaves generated from the magnetron 30 are sine waves, so that the field energy $E_y$ at a particular position in the cooking chamber 2 is the field energy $E_s$ multiplied by $\sin(\chi)$, where $\sin(\chi)$ is varied in value or phase thereof according to the states of foodstuff (by way of example; kind, quantity, cooking process status of the foodstuff and the like).

In other words, absorbed quantity of microwaves differs according to the kind and quantity of the foodstuff and gas quantity, such that the output power $P_{out}$ at the particular position in the cooking chamber 2 differs according to the kind and quantity of the foodstuff. Particularly, because the quantity of gas generated from the foodstuff according to the cooking process status differs, the $P_{out}$ is also changed variably according to the cooking process status.

For reference, impedance characteristic of the waveguide 6 according to the quantity of foodstuff can be described in the polar chart illustrated in FIG. 4, where the Voltage Standing Wave Radio VSWR, that is, the impedance of the waveguide 6 is decreased when load is water of 2,000 cc under the microwave frequency of 2.44–2.47 GHZ, to thereby increase the output of the magnetron, whereas the impedance of the waveguide 6 is increased to decrease the output of the magnetron 30 when the load is water of 100 cc.

However, there is a problem in the conventional microwave oven thus constructed in that a cooking time has been controlled simply according to weight of the foodstuff and quantity of gas detected by a weight sensor and a gas sensor without consideration of output variations of a magnetron in response to cooking process status, such that the foodstuff has not been optimally cooked when the output of the magnetron is changed according to the cooking process status.

By way of example, when the output of the magnetron is decreased by quantity of gas that varies in response to the cooking process status, cooking is terminated with foodstuff not fully cooked or with soup not fully boiled.

When the output of the magnetron is over-fed, there is a problem in that the foodstuff is over-cooked or the soup is boiled dry.

SUMMARY OF THE INVENTION

Accordingly, the present invention is disclosed to solve the aforementioned problems and it is an object of the present invention to provide a magnetron driving control apparatus of a microwave oven and a method thereof by which voltage of a high voltage transformer and a magnetron are detected to discriminate a cooking process status according to a result discriminated therefrom and to control the driving of the magnetron, thereby enabling an optimum cooking of foodstuff.

In accordance with one object of the present invention, there is provided a magnetron driving control apparatus of a microwave oven, the apparatus comprising:

- a first voltage detecting unit for detecting a voltage at an output side of a high voltage transformer;
- a second voltage detecting unit for detecting a voltage of a magnetron; and
- a control unit for controlling the driving of the magnetron according to the voltages detected by the first and second voltage detecting units.

In accordance with another object of the present invention, there is provided a magnetron driving control method of a microwave oven, the method comprising the steps of:

- driving a magnetron according to manipulation of a user to perform a cooking operation;
- detecting a voltage at an output side of a high voltage transformer and a voltage of the magnetron after the magnetron is driven at the cooking step, to thereby discriminate whether cooking is completed; and
- stopping the driving of the magnetron when it is discriminated that the cooking is completed at the cooking completion discriminating step.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
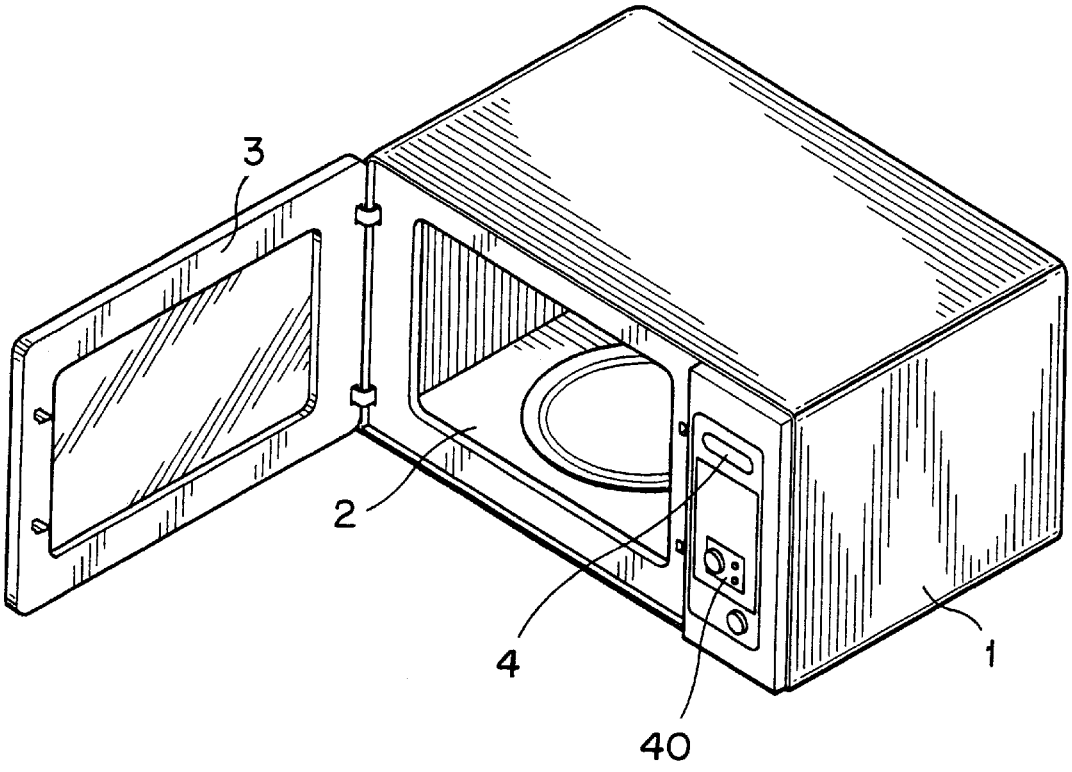
FIG. 1 (PRIOR ART)
FIG. 1 is a schematic perspective view of a conventional microwave oven.
Figure 2:
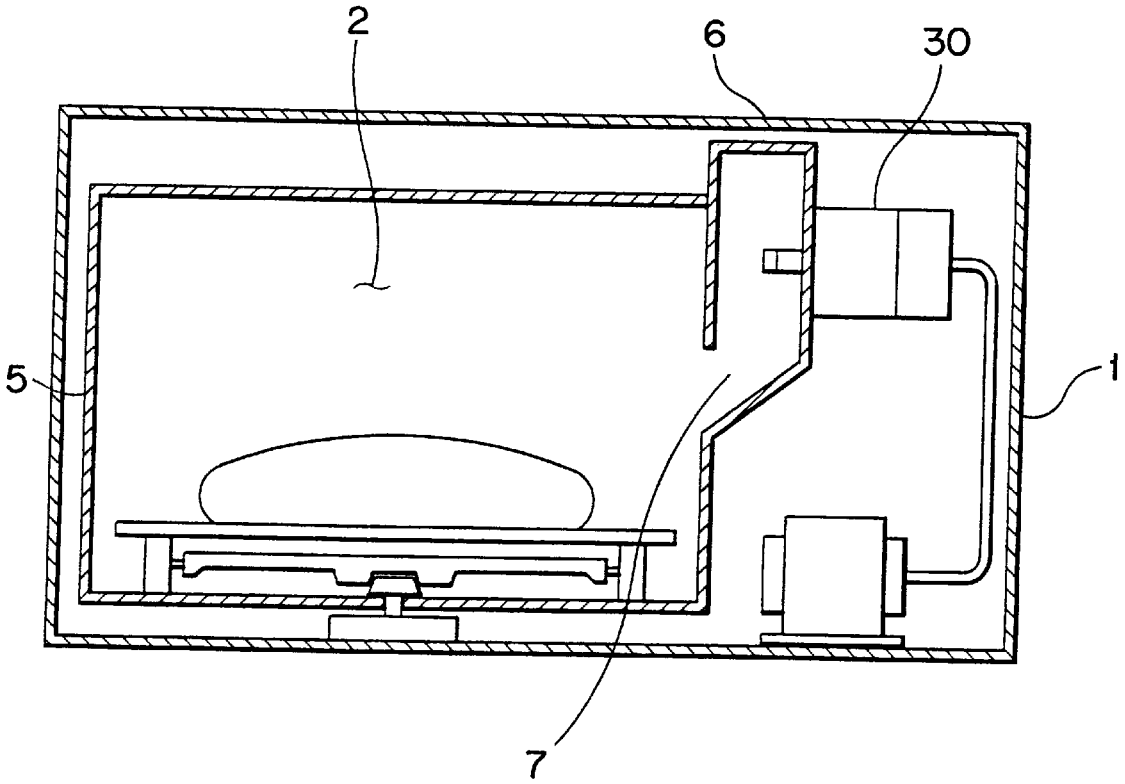
FIG. 2 (PRIOR ART)
FIG. 2 is a schematic sectional view of a conventional microwave oven.
Figure 3:
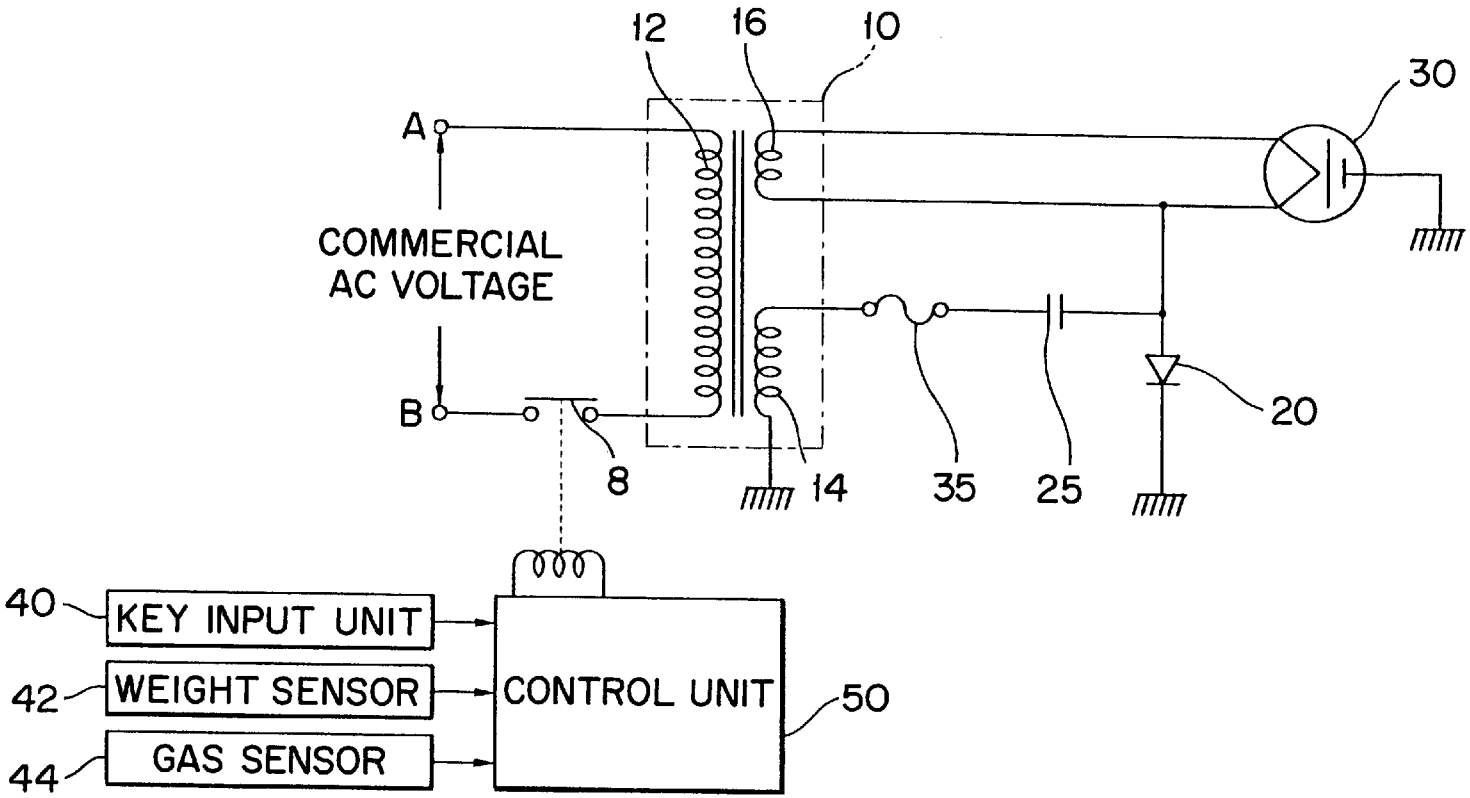
FIG. 3 (PRIOR ART)
FIG. 3 is a schematic block diagram of a conventional microwave oven.
Figure 4:
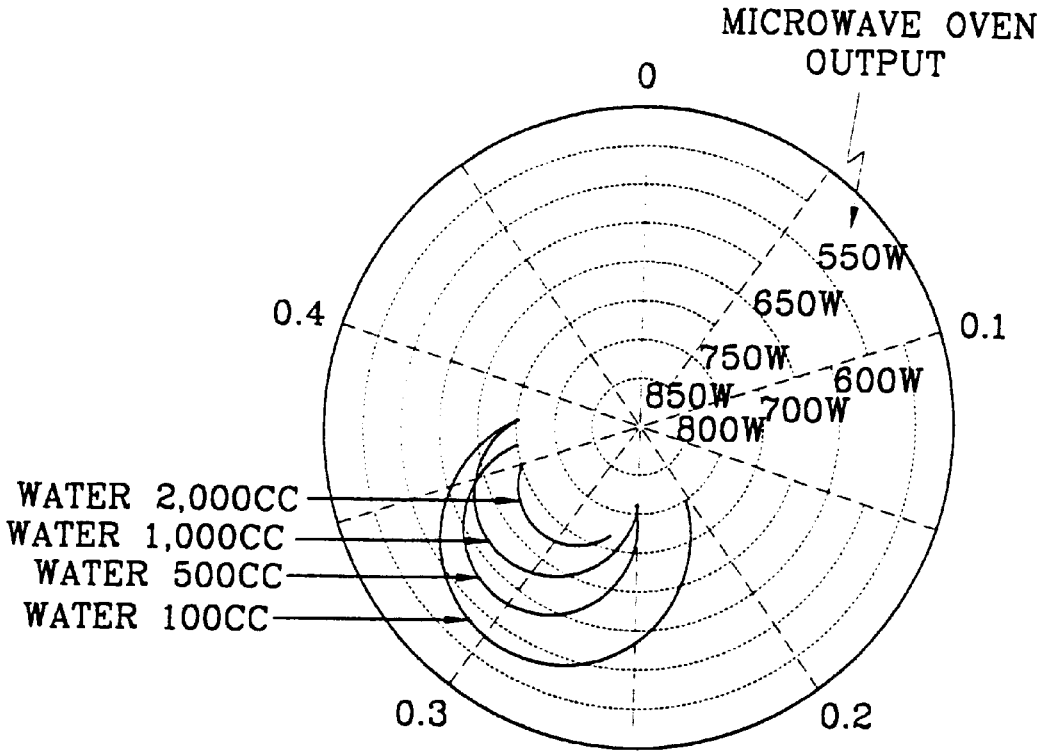
FIG.4 (PRIOR ART)
FIG. 4 is a schematic diagram of polarity for illustrating an impedance characteristic of a waveguide according to quantity of foodstuff.

Now, a preferred embodiment of the present invention will be described in detailed with reference to the accompanying drawings. Throughout the drawings, like reference numerals and symbols are used for designation of like or equivalent parts or portions to avoid redundancy.

Figure 5:
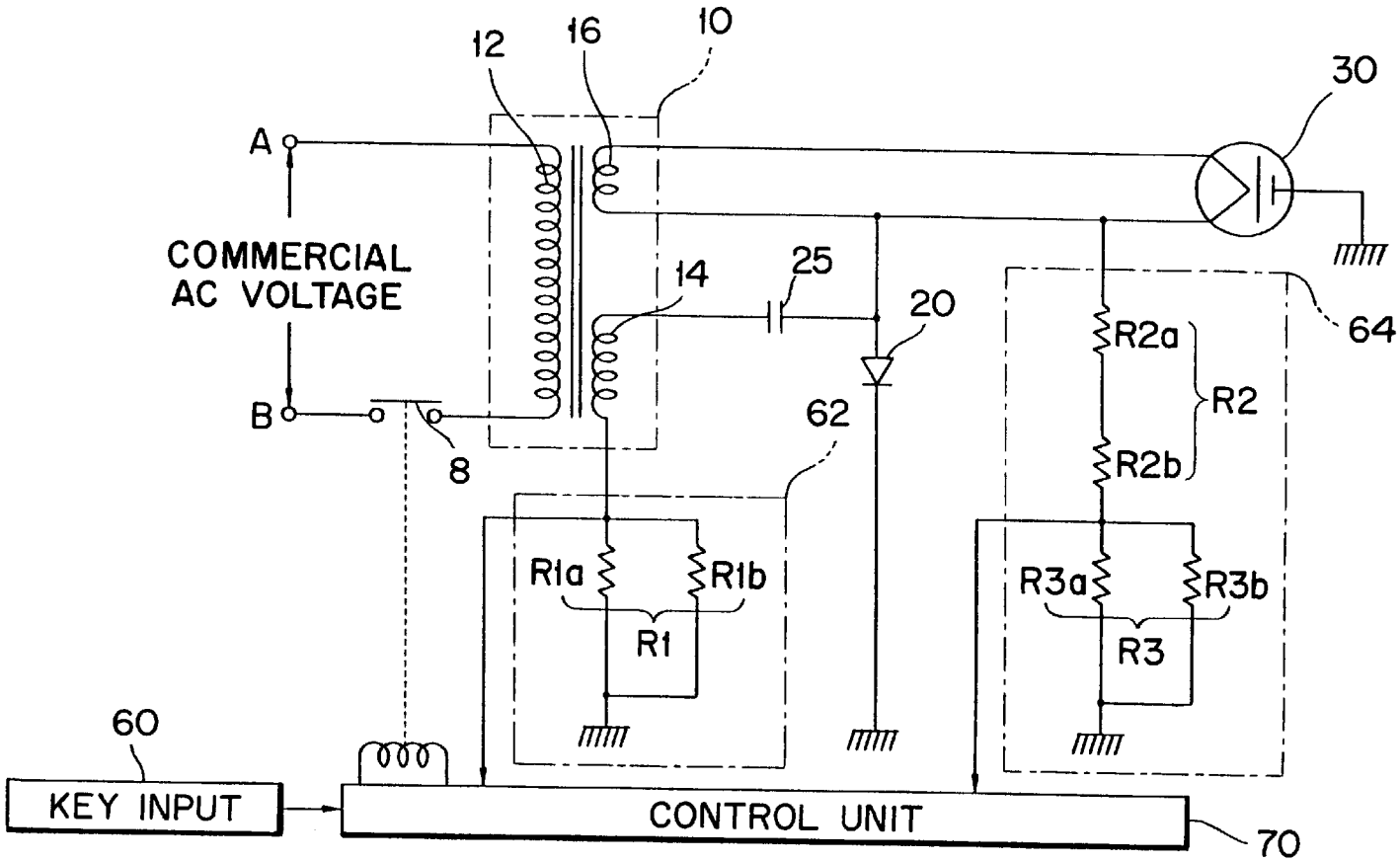
FIG. 5 is a schematic block diagram for illustrating a magnetron driving control apparatus of a microwave oven according to the present invention.

As illustrated in FIG. 5, the magnetron driving control apparatus of a microwave oven according to the present invention includes a relay unit 8, a high voltage transformer 10, a high voltage diode 20, a high voltage capacitor 25, a magnetron 30, a key input unit 60, a first voltage detecting unit 62, a second voltage detecting unit 64 and a control unit 70.

The first voltage detecting unit 62 serves to detect a voltage of a secondary coil 14 at the high voltage transformer 10. Here the first voltage detecting unit 62 includes a resistor R1*a* and a resistor R1*b*. Reference numeral R1 in the drawing represents a combined resistor value of R1*a* and R1*b*.

Furthermore, the second voltage detecting unit 64 serves to detect a voltage of the magnetron 30, where the second voltage detecting unit 64 includes resistors R2*a*, R2*b*, R3*a* and R3*b*. Reference numerals R2 and R3 represent combined resistor values of R2*a* and R2*b*, and R3*a* and R3*b* respectively. In order to avoid an electric shock, resistors R1*a* and R1*b* of the first voltage detecting unit 62 are connected in parallel, and resistors R3*a* and R3*b* of the second voltage detecting unit 64 are also connected in parallel.

The combined resistor value R2 of R2*a* and R2*b* against another combined resistor value R3 of R3*a* and R3*b* is established at a predetermined resistor ratio, preferably 1000:1.

The control unit 70 outputs a control signal for driving the magnetron 30 according to a key signal output from the key input unit 60, discriminates whether cooking is completed according to the voltages of the high voltage transformer 10 and the magnetron 30 detected by the first and second voltage detecting units 62 and 64, and outputs a control signal for stopping the driving of the magnetron 30 when it is discriminated that the cooking is completed.

Figure 6:
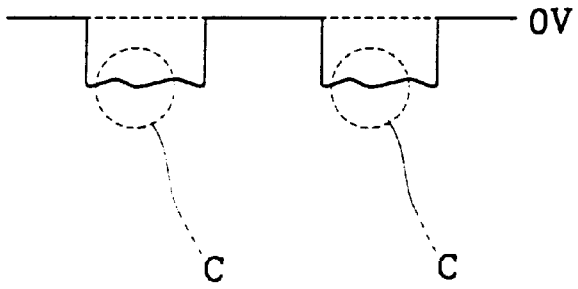
FIG. 6 is a schematic diagram for illustrating output voltages of first and second detecting units in FIG. 5.

Meanwhile, FIG. 6 is a schematic diagram for illustrating output voltage of the first and second detecting units in FIG. 5, where the voltages of the high voltage transformer 10 and the magnetron 30 detected by the first and second voltage detecting units 62 and 64 are average output voltages which are illustrated at "C" on the drawing.

Figure 7:
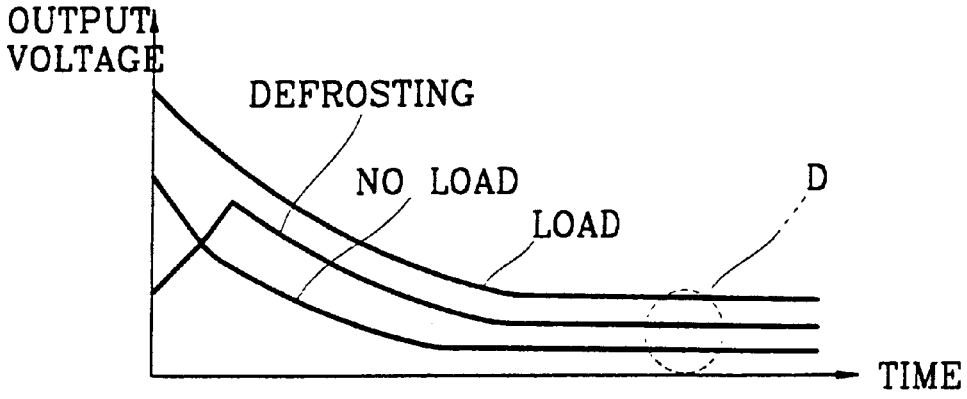
FIG. 7 is a schematic diagram for illustrating output voltage of the first and second detecting units according to cooking process status.
Figure 8:
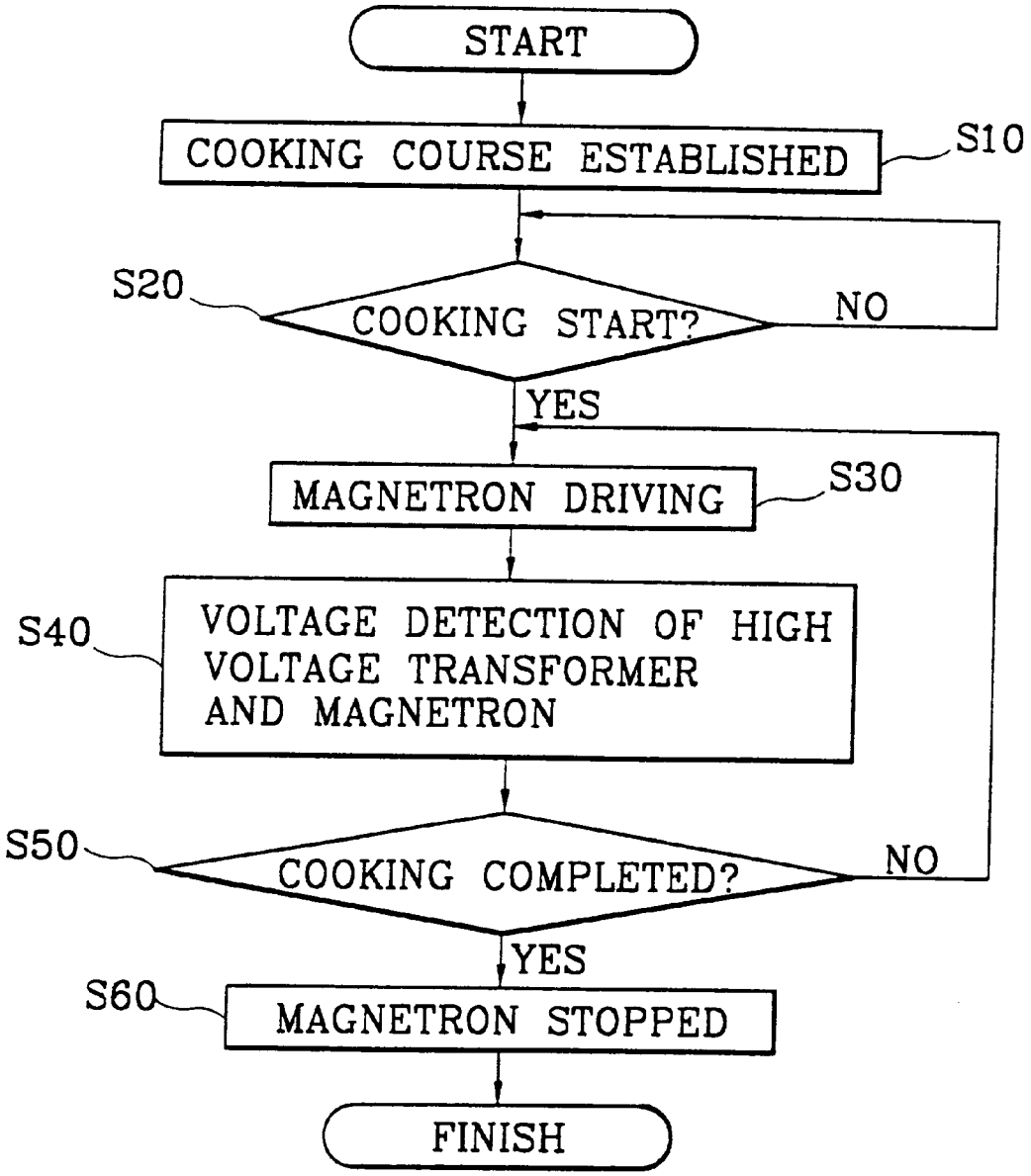
FIG. 8 is a schematic diagram for illustrating operational procedures of driving control method of a magnetron in a microwave oven according to the present invention.

Furthermore, FIG. 7 is a schematic diagram for illustrating output voltages of the first and second detecting units according to the cooking process status, where it illustrates changing states of the average output voltages per load (by way of example; during load, no load and defrosting) for the first and second voltage detecting units according to the cooking process status.

Here, according to one example for discriminating whether cooking has been completed, if the output voltages of the first and second detecting units 62 and 64 conform to a pre-established cooking completion voltage (by way of example; "D" portion in the drawing), it is discriminated that cooking is completed, whilst, according to another example for discriminating whether the cooking according to the present invention has been completed, if there is no change of voltages as illustrated in "D" portion at the first and second detecting units 62 and 64 for a predetermined period of time, the control unit 70 discriminates that the cooking is completed.

Now, operational process of the magnetron driving control method according to the present invention thus constructed will be described in detail with reference to FIGS. 5, 6, 7 and 8, where S denotes steps.

First of all, when a user inserts the foodstuff into the cooking chamber, establishes a cooking course via the key input unit 60 and starts the cooking, a key signal corresponding thereto is input for the key input unit 60 to the control unit 70, step S10.

The control unit 70 discriminates whether the user has instructed a cook start according to the key signal from the key input unit 60, step S20, and when it is discriminated that the cooking start has been instructed, a control signal is output to the relay unit 8 for driving the magnetron 30, step S30.

By this, the relay unit 8 is activated according to the control signal output from the control unit 70, and a commercial AC voltage is supplied from outside via input terminals A and B to the first coil 12 at the high voltage transformer 10 to apply a low voltage to the filament coil 16 and simultaneously a high voltage to the secondary coil 14, where the low voltage is supplied to filament of the magnetron 30 to pre-heat the filament and the high voltage is divided in voltages by the capacitor 25 and the diode 20 and rectified to be converted to a DC-type high voltage.

The divided and rectified DC-type high voltage is now supplied to both poles of the magnetron 30 to cause microwaves to be generated therefrom and the microwaves are radiated into the cooking chamber 2 via the opening 7 at the waveguide 6 to thereby heat and cook the foodstuff in the cooking chamber 2.

At this time, the quantity of gas generated from the foodstuff is varied according to the cooking process status to thereby change the output of the magnetron 30, and the voltage variation according to the output change of the magnetron, that is, a detected signal corresponding to output voltage from the secondary coil 14 at the high voltage transformer 10 is input to the control unit 70 from the first voltage detecting unit 62 and at the same time, a detected signal corresponding to the voltage of the magnetron 30 is input to the control unit 70 from the second voltage detecting unit 64.

Here, the control unit 70 detects an output voltage of the secondary coil 14 at the high voltage transformer 10 and a voltage of the magnetron 30 according to the detected signals input from the first and second voltage detecting units 62 and 64, and S40.

Successively, the control units discriminates whether cooking has been completed according to the voltage (to be more specific, the average output voltage illustrated as "C" portion in FIG. 6) and the output voltage of the secondary coil 14 of the high voltage transformer 10 detected at step S40, step S60.

Here, by way of example for discriminating whether cooking has been completed, the output voltage of the secondary coil 14 at the high voltage transformer 10 and the voltage of the magnetron 30 are compared with a pre-established voltage (to be more specific, the average output voltage of the first and second voltage detecting units according to the lapse of time, as illustrated in FIG. 7), and as a result of the comparison, a discrimination as to whether the cooking has been completed is performed.

In other words, if the output voltage of the secondary coil 14 at the high voltage transformer 10 and the voltage of the magnetron 30 conform to a pre-established cooking completion voltage (by way of example, "D" portion in FIG. 7), it is discriminated that the cooking has been completed.

Meanwhile, by way of another example for discriminating whether cooking has been completed, if there are no changes of output voltage of the secondary coil 14 at the high voltage transformer 10 and the voltage of the magnetron 30 for a predetermined period of time as illustrated in "D" portion in FIG. 7, it is discriminated by the control unit 70 that the cooking is completed.

As a result of the discrimination at step S60, if it is discriminated that the cooking has not been completed, flow returns to step S30 to maintain a driving status of the magnetron, and if it is discriminated that the cooking has been completed, the control unit 70 outputs a control signal to the relay unit 8 for stopping the drive of the magnetron 30, step S60.

Successively, the relay unit 8 is deactivated according to the control signal from the control unit 70 and supply of commercial AC voltage applied to the first coil 12 of the high voltage transformer 10 via input terminals A and B is cut off according to the deactivation of the relay unit 8.

Consequently, the output of filament coil 16 and the secondary coil 14 at the high voltage transformer 10 is stopped to thereby cease the driving of the magnetron 30 and to complete the overall cooking operations of the microwave oven.

As apparent from the foregoing, there is an advantage in the magnetron driving control apparatus of a microwave oven and method thereof according to the present invention, in that a cooking process status is discriminated by voltages of a high voltage transformer and a magnetron and a cooking operation is completed as a result of the discrimination to optimally cook the foodstuff.

There is another advantage in that by way of a simple construction without recourse to high priced sensors such as weight sensor, gas sensor and the like, an automatic cooking can be performed, to thereby reduce a manufacturing cost.

What is claimed is:

1. A microwave oven driving a magnetron according to a voltage applied from a high voltage transformer to perform a cooking operation, the microwave oven comprising:

a first voltage detecting unit for detecting a voltage at an output side of the high voltage transformer, and a second voltage detecting unit for detecting an input voltage into the magnetron; and the microwave oven further comprising:

a control unit comparing the voltages detected by the voltage detecting units with pre-established voltages, determining that cooking is complete when the detecting voltages are below the pre-established voltages, and stopping the driving of the magnetron if cooking is completed.

2. The microwave oven as defined in claim 1, wherein the first voltage detecting unit comprises a plurality of resistors connected in parallel to each other, one end of the plurality of parallel connected resistors being connected to an output side of the high voltage transformer and to a predetermined input terminal of the control unit, and the other end being connected to ground.

3. The microwave oven as defined in claim 1, wherein the second voltage detecting unit comprises at least more than one serial resistor, one end thereof being connected to an anode of the magnetron, and a plurality of resistors connected in parallel to each other, one end of the plurality of parallel connected resistors being connected to the other end of the serial resistor and to predetermined input terminal of the control unit, and the other end thereof being connected to ground.

4. A microwave oven driving a magnetron according to a voltage applied from a high voltage transformer to perform a cooking operation, the microwave oven comprising:

a first voltage detecting unit for detecting a voltage at an output side of the high voltage transformer, and a second voltage detecting unit for detecting an input voltage into the magnetron; and the microwave oven further comprising:

a control unit confirming changes in levels of voltages detected by at least one of said first and second voltage detecting units, determining that cooking is completed if a ratio of change in the detected voltages are below reference variation ratios for a predetermined period of time, and stopping the driving of the magnetron if cooking is completed.

5. The microwave oven as defined in claim 4, wherein the first voltage detecting unit comprises a plurality of resistors connected in parallel to each other, one end of said plurality of parallel connected resistors being connected to an output side of the high voltage transformer and to a predetermined input terminal of the control unit, and the other end being connected to ground.

6. The microwave oven as defined in claim 4, wherein the second voltage detecting unit comprises at least more than one serial resistor, one end thereof being connected to an anode of the magnetron, and a plurality of resistors connected in parallel to each other, one end of the plurality of parallel connected resistors being connected to the other end of the serial resistor and to predetermined input terminal of the control unit, and the other end thereof being connected to ground.

7. A magnetron driving control method of a microwave oven for driving a magnetron according to a voltage applied from a high voltage transformer to thereby perform a cooking operation, the method comprising the steps of:

driving a magnetron according to manipulation of a user to perform the cooking operation;

detecting the output voltages of a high voltage transformer and an input voltage into the magnetron after the magnetron is driven;

comparing the detected voltages with pre-established voltages;

determining that cooking is completed if the detected voltages are below the pre-established voltages; and stopping the drive of the magnetron, if the cooking operation has been completed.

8. A magnetron driving control method of a microwave oven for driving a magnetron according to a voltage applied from a high voltage transformer to thereby perform a cooking operation, the method comprising the steps of:

driving a magnetron according to manipulation of a user to perform the cooking operation;

detecting the output voltages of a high voltage transformer and an input voltage into the magnetron after the magnetron is driven;

confirming variations in levels of the detected voltages;

discriminating that cooking is completed if variation ratios of the detected voltages are below reference ratios for a predetermined period of time; and stopping the drive of the magnetron, if the cooking has been completed.

* * * * *